US006135441A

United States Patent [19]

Belec et al.

[11] Patent Number: 6,135,441

[45] Date of Patent: Oct. 24, 2000

[54] TWO-STAGE DOCUMENT SINGULATING APPARATUS FOR A MAIL HANDLING SYSTEM

[75] Inventors: Eric A. Belec, Southbury; Donald E. Barker, Sandy Hook; Steven E. Cohen, Seymour; James A. Salomon, Cheshire; Denis J. Stemmle, Sr., Milford, all of Conn.

[73] Assignee: Pitney Bowes Inc., Stamford, Conn.

[21] Appl. No.: 08/991,649

[22] Filed: Dec. 16, 1997

[51] Int. Cl.[7] ..... B65H 3/04; B65H 3/52

[52] U.S. Cl. ..... 271/35; 271/121; 271/122

[58] Field of Search ..... 271/35, 121, 122, 271/160; 221/35, 121, 122

[56] References Cited

U.S. PATENT DOCUMENTS

| | | | |
|---|---|---|---|
| 4,436,298 | 3/1984 | Donner et al. | 271/10 X |
| 4,615,519 | 10/1986 | Holodnak et al. | 271/122 |
| 4,978,114 | 12/1990 | Holbrook | 271/35 |
| 5,029,839 | 7/1991 | Kajiwara et al. | 271/121 |
| 5,033,729 | 7/1991 | Struthers . | |
| 5,072,921 | 12/1991 | Golicz | 271/35 |
| 5,238,236 | 8/1993 | Belec et al. | 271/34 |
| 5,334,134 | 8/1994 | Saeki et al. | 271/122 |

FOREIGN PATENT DOCUMENTS

| | | | |
|---|---|---|---|
| 004217618 | 12/1992 | Germany | 271/122 |
| 0291340 | 12/1986 | Japan | 271/122 |
| 0081723 | 3/1989 | Japan | 271/122 |
| 0317931 | 12/1989 | Japan | 271/122 |

*Primary Examiner*—Christopher P. Ellis
*Assistant Examiner*—Kenneth W Bower
*Attorney, Agent, or Firm*—Steven J. Shapiro; Michael E. Melton

[57] ABSTRACT

A two-stage document singulating apparatus includes first and second singulators disposed along a document feed path. The first singulator acts to separate individual documents from a stack which are subject to a stack advance mechanism force. The second singulator separates multi-feeds that pass through the first singulator and which are no longer subject to the stack advance mechanism force.

8 Claims, 5 Drawing Sheets

TWO-STAGE DOCUMENT SINGULATING APPARATUS FOR A MAIL HANDLING SYSTEM

BACKGROUND

The processing and handling of mailpieces and other documents consumes an enormous amount of human and financial resources, particularly if the processing of the mailpieces is done manually. The processing and handling of mailpieces not only takes place at the Postal Service, but also occurs at each and every business or other site where communication via the mail delivery system is utilized. That is, various pieces of mail generated by a plurality of departments and individuals within a company need to be collected, sorted, addressed, and franked as part of the outgoing mail process. Additionally, incoming mail needs to be collected and sorted efficiently to ensure that it gets to the addressee in a minimal amount of time. Since much of the documentation and information being conveyed through the mail system is critical in nature relative to the success of a business, it is imperative that the processing and handling of both the incoming and outgoing mailpieces be done efficiently and reliably so as not to negatively impact the functioning of the business.

In view of the above, various automated mail handling machines have been developed for processing mail (removing individual pieces of mail from a stack and performing subsequent actions on each individual piece of mail). However, in order for these automatic mail handling machines to be effective, they must process and handle "mixed mail." The term "mixed mail" is used herein to mean sets of intermixed mailpieces of varying size (postcards to 9" by 12" flats), thickness, and weight. In addition, the term "mixed mail" also includes stepped mail (i.e. an envelope containing therein an insert which is smaller than the envelope to create a step in the envelope), tabbed and untabbed mail products, and mailpieces made from different substrates. Thus, the range of types and sizes of mailpieces which must be processed is extremely broad and often requires trade-offs to be made in the design of mixed mail feeding devices in order to permit effective and reliable processing of a wide variety of mixed mailpieces.

In known mixed mail handling machines which separate and transport individual pieces of mail away from a stack of mixed mail, the stack of "mixed mail" is first loaded onto some type of conveying system for subsequent sorting into individual pieces. The stack of mixed mail is moved as a stack by an external force to, for example, a shingling device. The shingling device applies a force to the lead mailpiece in the stack to initiate the separation of the lead mailpiece from the rest of the stack by shingling it slightly relative to the stack. The shingled mailpieces are then transported downstream to, for example, a separating or singulating device which completes the separation of the lead mailpiece from the stack so that individual pieces of mail are transported further downstream for subsequent processing. In the mailing machine described immediately above, the various forces acting on the mailpieces in moving the stack, shingling the mailpieces, separating the mailpieces and moving the individual mailpieces downstream often act in a counterproductive manner relative to each other. For example, inter-document stack forces exist between each of the mailpieces that are in contact with each other in the stack. The inter-document stack forces are created by the stack advance mechanism, the frictional forces between the documents, and potentially electrostatic forces that may exist between the documents. The inter-document forces tend to oppose the force required to shear the lead mailpiece from the stack. Additionally, the interaction of the force used to drive the shingled stack toward the separator and the separator forces can potentially cause a thin mailpiece to be damaged as it enters the separator. Furthermore, in a conventional separator, there are retard belts and feeder belts that are used to separate the mailpiece from the shingled stack. Both the forces applied by the retard belts and the feeder belts must be sufficient to overcome the inter-document forces previously discussed. However, the friction force generated by the retard belts cannot be greater than that of the feeder belts or the mailpieces will not be effectively separated and fed downstream to another mail processing device. Moreover, if the feeding force being applied to the mailpieces for presenting them to the separator is too great, another potential problem which may occur is that a plurality of mailpieces (multi-feeds) will be forced through the separator without the successful separation of the mailpieces.

In view of the above, it is recognized that large forces are desirable to act on the mailpieces to accelerate and separate the mailpieces in a reliable and high throughput manner. However, these same high forces can damage the mailpieces being processed (i.e. buckled lightweight mailpieces). Conversely, if the forces used to accelerate and separate the mailpieces are too small, poor separation, a lower throughput, and stalling of the mailpieces being processed will result. Put in another way, thin mailpieces are weak and require low forces to prevent them from being damaged, while thick/heavy mail is strong and requires high forces for proper separation and feeding. That is, when the thick/heavy mail is in the stack higher stack normal forces are created thereby increasing inter-document forces and requiring higher nip forces at the separator. Thus, the structure used to separate a stack of mixed mail must take into account the counterproductive nature of the forces acting on the mailpieces and be such that an effective force profile acts on the mailpieces throughout their processing cycle so that effective and reliable mailpiece separation and transport at very high processing speeds (such as four mailpieces per second) can be accomplished without physical damage occurring to the mailpieces. However, since the desired force profile acting on a particular mailpiece is dependent upon the size, thickness, configuration, weight, and substrate of the individual mailpiece being processed, the design of a mixed mail feeder which can efficiently and reliably process a wide range of different types of mixed mailpieces has been extremely difficult to achieve.

SUMMARY OF THE INVENTION

It is an object of the invention to provide a singulating apparatus which separates individual documents from a stack of documents of without causing damage to the individual documents.

The above object is met by providing a singulating apparatus including: a first singulator having a first retard assembly and a first feed assembly disposed opposite to each other along the document feed path, the first retard assembly and the first feed assembly cooperating together on a stack of documents being transported along the document feed path and passing between the first feed assembly and the first retard assembly to separate and transport downstream along the document feed path individual documents from the stack of documents; and a second singulator, positioned downstream along the document feed path from the first singulator, having a second retard assembly and a second feed assembly disposed opposite to each other along the document feed path, and wherein at times when a plurality of documents from the stack of documents that are in overlapping relationship with each other pass through the first singulator without being separated and are received by the second singulator the second retard assembly and the second feed assembly cooperate together on the plurality of documents to separate and transport individual ones of the plurality of documents downstream along the document feed path.

It is yet a further objective to provide a singulating apparatus which can effectively be utilized for processing both a stack of individual documents which are each non-shearable and a stack of individual documents which are each shearable.

This object is met by providing a singulating apparatus comprising a feed assembly including means for exerting a downstream friction force relative to the document feed path on a first successive document of the stack of documents; a retard assembly for exerting a retard assembly friction force on a first next successive document in overlapped relationship with the first successive document and being operable in 1) a first mode wherein the retard assembly friction force is an upstream friction force relative to the document feed path which is greater than the inter-document force thereby feeding the first next successive document upstream along the document feed path and wherein the downstream friction force is greater than the inter-document friction force and the retard assembly upstream friction force such that the first successive document is separated from the stack of documents and fed individually downstream along the document feed path and 2) a second mode wherein the retard assembly friction force is directed downstream along the document feed path so that the retard assembly and the feed assembly operate in cooperation to feed documents downstream along the document feed path.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate a presently preferred embodiment of the invention, and together with the general description given above and the detailed description of the preferred embodiment given below, serve to explain the principles of the invention.

DETAILED DESCRIPTION OF THE PREFERRED EMBODIMENTS

Figure 1:
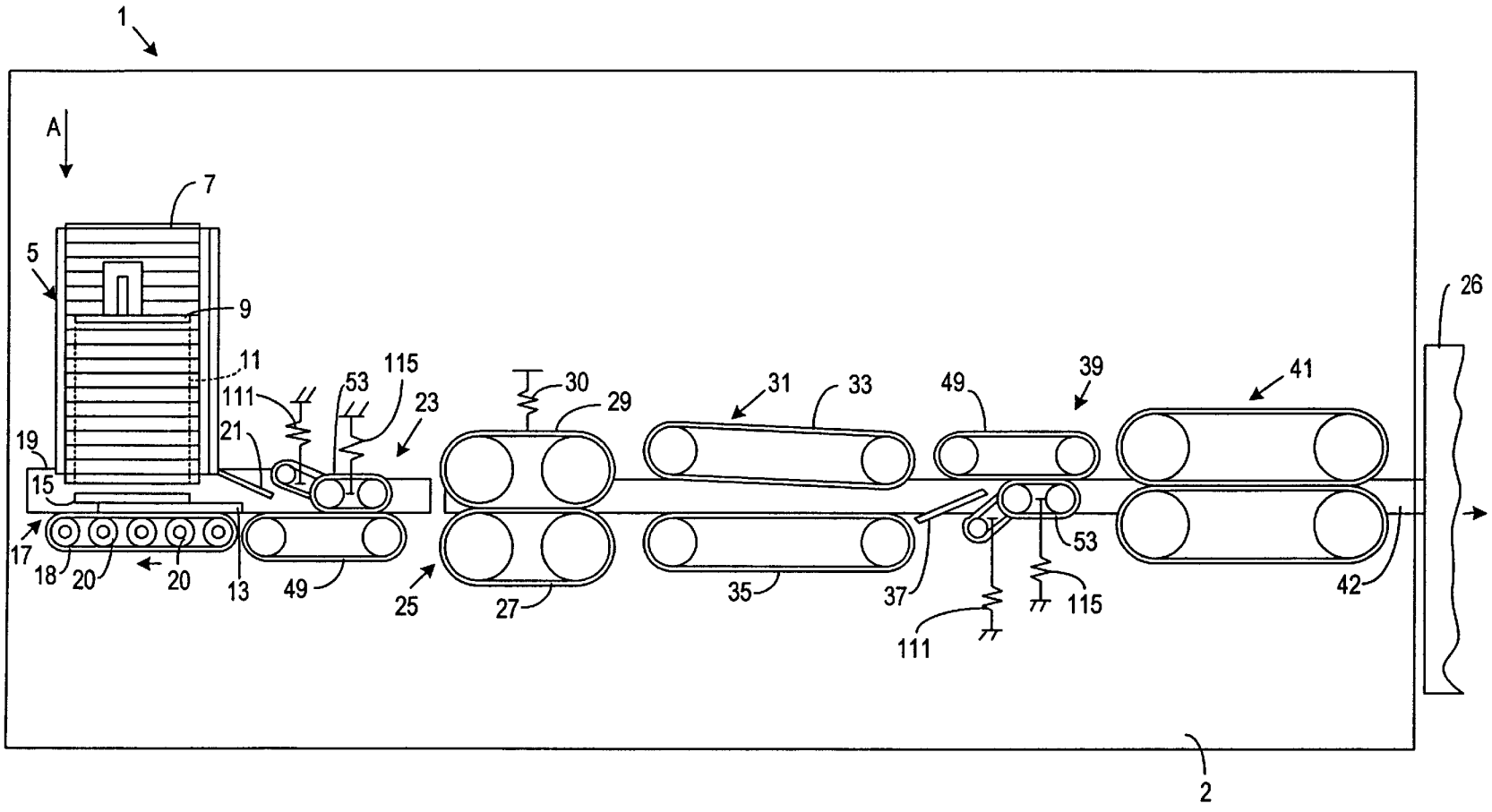
FIG. 1 is a schematic top plan view of a mixed mail feeder incorporating the inventive singulating apparatus.

FIG. 1 shows a mixed mail feeder 1 having conventional framework 2 upon which all of the components of the mixed mail feeder 1 are mounted. Mixed mail feeder 1 includes a stack advance mechanism 5 having a continuous conveyor belt 7 mounted for rotation in a conventional manner about a plurality of pulleys (not shown) in the direction of arrow "A". Mounted on the conveyor belt 7 in a conventional manner is an upstanding panel 9 which moves with the conveyor 7 in the direction of arrow "A". In operation, a stack of mixed mail 11 is placed on the conveyor belt 7 and rests against the panel 9. The stack of mixed mail includes a lead mailpiece 13 and a second mailpiece 15. Thus, as the conveyor belt 7 is set into movement, the stack of mixed mail 11 is moved toward an input feed structure 17. Input feed structure 17 includes a belt 18 which is driven into rotation about a series of pulleys 20, at least one of which is a driven pulley. Accordingly, as the stack advance mechanism 5 forces the lead mailpiece 13 into contact with the belt 18, the lead mailpiece 13 is laterally moved away from stack of mixed mail 11. Additionally, a driven belt 19 which makes contact with the bottom edge of the lead mailpiece 13 also assists in moving the lead mailpiece 13 downstream past a guide mechanism 21 and toward a document singulating apparatus 23. As shown, the combination of the stack advance mechanism 5, the input feed structure 17, and the guide plate 21 help to present the mailpieces which are removed from the stack of mixed mail 11 into the document singulating apparatus 23 in a shingled manner as is more clearly shown in FIG. 2. Document singulating apparatus 23 operates to separate the lead mailpiece 13 from the remaining stack of mixed mail 11 so that only individual mailpieces are presented to output feeding structure 25 for ultimate processing downstream to a processing station 26 where each individual mailpiece has some type of operation (metering, scanning, etc.) performed thereon.

Output feeding structure 25 includes a driven belt structures 27 and 29 which receive the mailpiece as it exits the document singulating apparatus 23 and helps to transport it downstream. Belt structure 29 is spring loaded by spring 30 and is moveable toward and away from belt structure 27 to accommodate different mailpiece thicknesses A buffer station 31 consisting of 2 driven belt structures 33, 35 help to buffer the individual mailpieces to ensure that they are aligned on their bottom edge prior to transport past a second guide plate 37 and into a second document singulating apparatus 39. Subsequent to passage through the second document singulating apparatus 39, the individual mailpieces are transported into a second output feed structure 41 which acts on the mailpieces together with a driven belt structure 42 to transport the individual mailpieces to the processing station 26. It is also the case that belt 42 acts on the bottom edges of the mailpieces transporting them through buffer station 31. Moreover, the belt structures 33, 35 are separated from each other on each side of the mailpiece feed path 51 by a distance of approximately 1.5 inches. This spacing allows most multi-feeds which leave separator 23 to be transported through buffer station 31 without any large inter-document forces existing between the mailpieces because no significant normal feed force is present when the mailpieces are fed by belt 42. Additionally, it has been found that by utilizing the driven belts 33, 35 mailpieces which curl up in buffer station 31 are still transported out of buffer station 31. If the driven belts 33, 35 were replaced with fixed wall structures curled mailpieces might get stuck in the buffer station 31 causing a jam condition.

Figure 2:
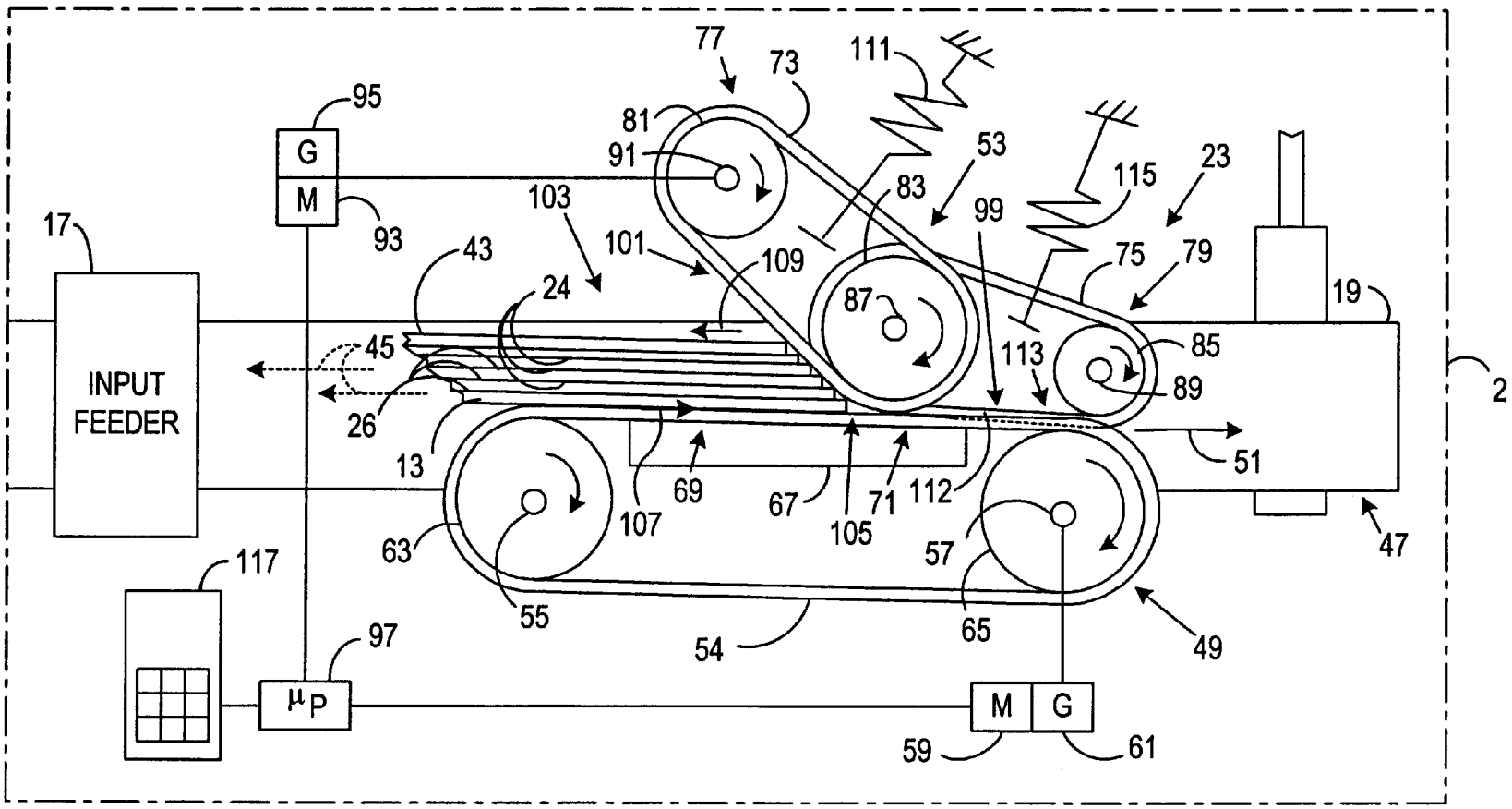
FIG. 2 is an enlarged and detailed top plan view of a singulator of FIG. 1.

Referring to FIG. 2, an enlarged view of the document singulating structure 23 is shown. As shown, singulating apparatus 23 has received a stack of shingled mailpieces of varying thickness 43 which has been separated from the stack of mixed mail 11 by the input feeder 17. For the purpose of this disclosure the stack of shingled mailpieces 43 can include envelopes, with or without one or more other documents stuff therein which are or are not folded, or a sheet such as a cut sheet, which is or is not folded, or a card, remittance form, mailpiece, magazine, or other sheet, or a collation of sheets which are or are not folded. As previously discussed, each of the individual mailpieces are preferably uprightly oriented on their lower edge and have oppositely outwardly facing, upright, surfaces 24 and 26. Each of the individual documents in the stack of shingled mailpieces 43 is slidably movable, out of engagement with the adjacent document, against an inter-document frictional force 45 developed between the adjacent ones of surfaces 24 and 26 in the course of such disengagement.

The document singulating apparatus 23 generally includes a deck 47 upon which the individual documents of the stack of shingled mailpieces 43 are fed. Although the deck 47 is preferably a horizontally-extending conveyor belt 19 as shown, it maybe a conventional, horizontally-extending plate having an upper surface which is coated with a low coefficient of friction material, such as Teflon or delring. The low coefficient of friction material reduces the frictional resistance to the sliding movement thereon of the lower edges of the individual documents. In addition, the document singulating apparatus 23 includes a feed assembly 49 for feeding each individual document of the stack of shingled mailpieces 43 downstream along a path of travel 51 on the deck 32. Document singulating apparatus 23 further includes a retard assembly 53 for feeding each next successive document of the stack of shingled mailpieces 43 upstream relative to the path of travel 38. That is, the feed assembly 49 interacts with the lead mailpiece 13 to move it downstream along the path of travel 51 while the retard assembly 53 causes the remainder of the documents in the stack of shingled mailpieces 43 to be moved slightly upstream. The forces respectively exerted by the feed assembly 49 on the lead mailpiece 13 and the retard assembly on the remaining documents in the stack are sufficient to overcome the inter-document force between the lead mailpiece and the next successive document in the stack. Thus, when the document singulating apparatus 23 operates as intended, only an individual document at a time leaves the document singulating apparatus 23 for presentation to the output feeding structure 25.

Feed assembly 49 preferably includes three endless belts 54 (only one shown). In addition, feed assembly 49 includes a pair of vertically oriented, parallel shafts 55, 57 which are conventionally mounted to the framework 2 for rotation. Preferably, the upstream shaft 55 is an idler shaft and the downstream shaft 57 is a drive shaft which is driven into rotation by a motor 59 via a conventional gear train 61. Further, feed assembly 49 includes three idler pulleys 63 (only one of which is shown) and three driven pulleys 65 (only one shown), which are respectively, conventionally mounted for rotation on the upstream and downstream shafts 55 and 57. Preferably, the pulleys 63 and 65 on each shaft 55 and 57 are located at substantially equally vertically-spaced intervals above the deck 47, and thus along the shafts 55 and 57. Each of belts 54 are looped about a corresponding pair of pulleys 55, 57 which are located at the same interval on shafts 55 and 57, respectively, whereby the belts 54 extend substantially horizontally parallel to one another above the deck 47.

The feed assembly 49 also includes a vertically oriented guide plate 67 which is conventionally fixedly connected to the framework 2 between the upstream and downstream shafts 55 and 57. As constructed and arranged, each belt 54 includes an upstream belt run, generally designated 69, which extends between the mid point of guide plate 67 and the upstream idler pulleys 63, and a downstream belt run generally designated 71, which extends between the mid point of guide plate 67 and downstream driven pulleys 65. Further, belts 54 and thus the respective upstream and downstream belt runs, 69 and 71, are suspended parallel to one another above deck 32 for feeding documents downstream thereon. Moreover, guide plate 67 is parallel to the path of travel 51, and is dimensioned for aligning the downstream belt runs 71 relative to the output feeding structure 25, to support belts 54 and to optimally define the path of travel 51 for feeding individual documents of the stack of shingled mailpieces 43 downstream to the output feeding structure 25.

The retard assembly 53 includes two outboard endless belts 73 and two inboard endless belts 75. In addition, the retard assembly 53 includes a first section 77 and a second section 79 which are connected together for movement relative to each other. The outboard belts 73 are disposed around a plurality of corresponding driven pulleys 81 as well as around a plurality of idler double track pulleys 83. Moreover, the inboard belts 75 are respectively disposed around a corresponding one of the double track pulleys 83 as well as around a corresponding idler pulley 85. The double track pulleys 83 are mounted on an idler shaft 87 while the idler pulleys 85 are mounted on an idler shaft 89. Driven pulley 81 is mounted on a shaft 91 which is selectively driven into rotation by a motor 93 via a gear train 95. Both the motor 93 associated with the feed assembly 49 and the motor 59 associated with the feed assembly 49 are controlled by a microprocessor 97.

Figure 3:
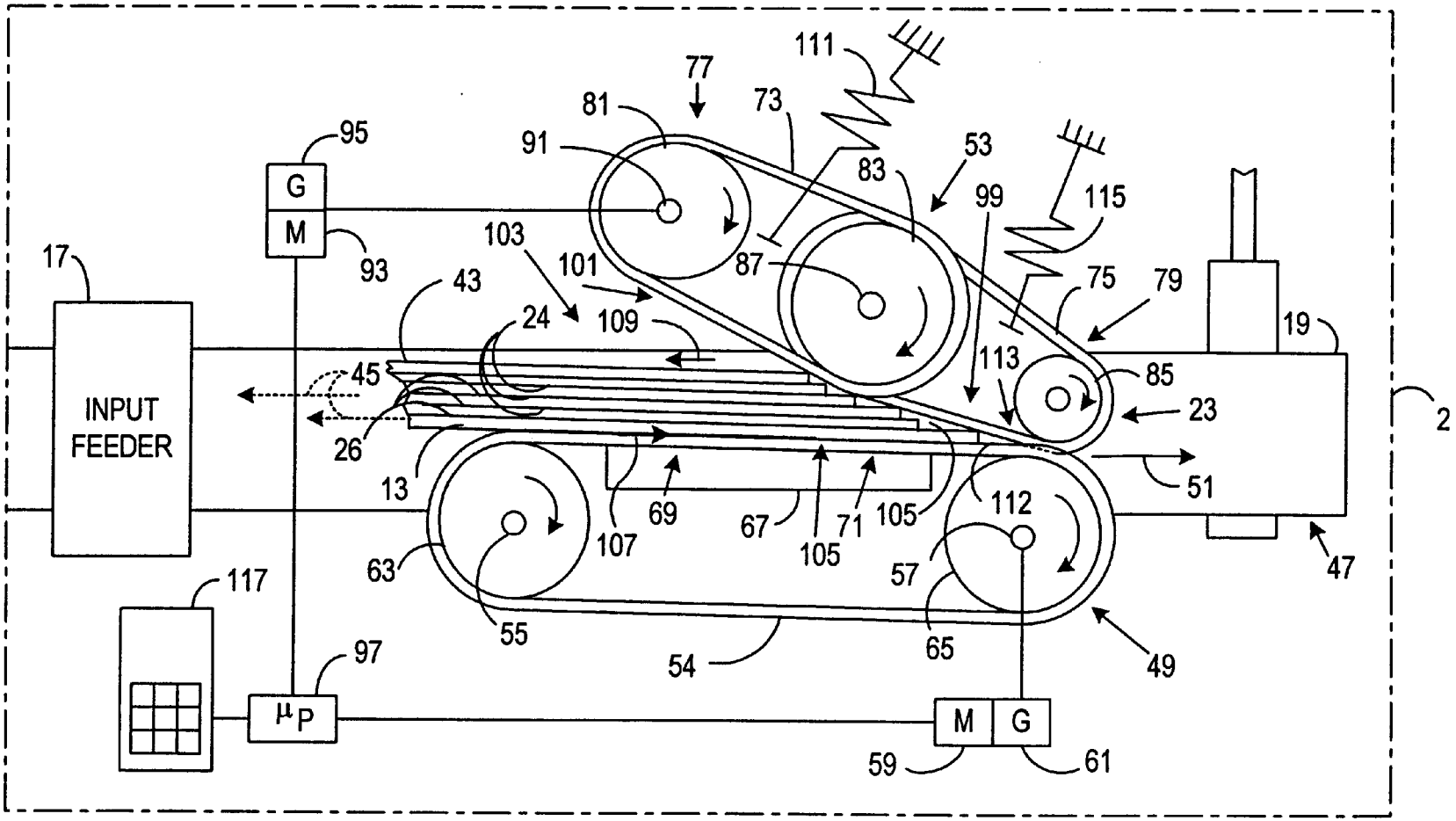
FIG. 3 is an enlarged and detailed top plan view of a singulator of FIG. 1 but showing a lead mailpiece further ingested into its nip as compared to FIG. 2.

Referring to FIGS. 2 and 3, when the stack of shingled documents 43 are not being fed to singulating apparatus 23, belt runs 99 of belts 75 of retard assembly 53 are parallel to the belt runs 71 of belts 54 of feed assembly 49. On the other hand, the belt runs 101 of the retard assembly 53 extend progressively upstream and are laterally spaced from the upstream end of, and cooperate with, the upstream belt runs 69 of the feed assembly 49 to define a wedge-shaped document entry opening, generally designated 103, into which the shingled stack of documents 43 are fed from the input feeding structure 17. As the shingled stack of documents 43 enter the opening 103, the upstream belt runs 69 frictionally engage the upright surface 24 of the lead mailpiece 13 and feeds the same downstream relative to the path of travel 51 to a nip 105 formed by the belts 54 and 73 at the juncture of the wedge-shaped opening 103. The runs 101 tend to feed the documents other than the lead mailpiece 13 upstream relative to the path of travel 51. Since the downstream force 107, exerted against the document surface 24 of lead mailpiece 13 by the belt runs 69, exceeds the inter-document frictional force 28 and the upstream force 109 exerted by the belt runs 101, the lead document 13 is engaged by the upstream belt runs 71 and fed downstream into the nip 105. At this point in time the belts 75 and pulleys 83 are laterally moved, against the resilient urging of spring 111, away from the path of travel 51 by the lead mailpiece 13 thereby the opening the nip 105 as lead mailpiece 13 is fed downstream along the path of travel 51 between the downstream belt runs 71 and 99. The lead mailpiece 13 is then fed downstream by the downstream belt runs 71 against an upstream frictional force 109 exerted by the belt runs 99. As shown in the FIGS. 2 and 3, the downstream belt runs 71 and 99 define a second wedge-shaped opening generally designated 112. The lead mailpiece 13 is progressively moved downstream toward the pulleys 65 and 85 such that the lead mailpiece 13 progressively urges belt runs 99 out of interleaving relationship with the belt runs 71. When the lead mailpiece 13 is fed into a nip 113 defined between pulleys 65 and 85, the lead mailpiece 13 has urged the belt 75 completely out of the interleaved relationship with the belts 54 against the resilient urging force of spring 115. The lead mailpiece 13 is then fed downstream between the pulleys 85 and 65 to the output feeding structure 25.

The operation of the feed assembly 49 and the retard assembly 53 in separating individual mailpieces is conventional as described as in U.S. Pat. No. 5,238,236, which is hereby incorporated by reference. While the singulating apparatus has worked remarkably well for conventional mixed mail such as envelopes and flats, a problem occurs when processing easily "shearable documents" which are often mailed through the postal service. Shearable documents include, but are not limited to, such items as newspapers, magazines, and untabbed folded documents. The problem encountered when processing shearable documents is that the individual sheets or pages of the document are intended to remain together and not be separated. Thus, when a shearable document enters into singulating apparatus 23 the forces 109 applied by the retard assembly 53, which act in opposition to the feed force 107 of the feed assembly 49, shear the individual pages or sheets of the easily shearable document from each other. As a result, except for the lead page or sheet, the remaining pages or sheets become buckled in the separator nip and can potentially even be torn when passing through the singulating apparatus. Moreover, not only are the shearable documents subject to damage but the singulating apparatus itself may be come jammed.

The instant singulating apparatus 23 has been modified with respect to the structure of U.S. Pat. No. 5,238,236 in that the motor 93 is a reversible motor which can drive shaft 91 in the direction shown in FIG. 2 or in the opposite direction thereof via selection by an operator of the desired operating mode utilizing a keyboard 117 in communication with microprocessor 97. Accordingly, when individual shearable documents are manually fed into the mixed mail feeder 1, the retard assembly 53 is designated via keyboard 117 to drive belts 77 and 75 in the counterclockwise direction of FIG. 2 at the same velocity as the feed belts 54 of the feed assembly 49. Thus, the feed assembly 49 and retard assembly 53 now act in corporation together to form a positive transport device for transporting the individual shearable documents downstream without damage thereto. While the above describes one way for changing the drive direction of belts 77 and 75, one skilled in the art will recognize that manually activated gear and linkage arrangements could also be utilized as well as electromagnetic clutches for the same purpose.

In prior art mail handling machines a single singulating apparatus (such as that disclosed in U.S. Pat. No. 5,238,236) was used to effectuate reliable separation of documents from each other. Unfortunately, when such a singulator is utilized in connection with a mixed mail stream ranging in thickness from approximately 0.007 inches to 0.75 inches (or higher), a problem occurs in that the nip force required to separate thick mailpieces needs to be significantly greater than the nip force required to separate a thin mailpiece such as a postcard. Accordingly, if the singulator is designed to effectively separate the mailpieces having high inter-document forces therebetween very thin mailpieces may actually become damaged by being buckled in the separator nip. On the other hand, if the singulator is designed with too small a nip force, effective separation of some of the mailpieces may not occur resulting in what is commonly referred to as a "multi-feed" situation. It has been observed that, in particular, in the situation reflected in FIG. 4 where a small mailpiece "SM" is followed by a thick and larger mailpiece "LM" the likelihood of a multi-feed (both the small and large mailpieces being passed through the singulator together) occurring is greatly increased.

In order to overcome the above-mentioned problem, the mixed mail feeder 1 of FIG. 1 incorporates the second singulating apparatus 39 downstream from the first singulating apparatus 23. The second singulating apparatus 39 has the same structural components as the singulating apparatus 23 and can be driven by an independent drive system similar to that used for singulating apparatus 23. The use of the redundant singulating apparatus structure improves the reliability of separating individual documents from each other by the simple fact that if a multi-feed does pass through the first singulating apparatus 23 it is likely that the second singulating apparatus 39 will effectively separate the documents of the multi-feed. Additionally, because of the use of redundant singulating apparatus 39, the singulating nip force at singulating apparatus 23 (as well as at singulating apparatus 39) applied by each of the springs 111 and 115 can be significantly reduced which helps to prevent damage from occurring to thin mailpieces being processed through singulators 23 and 39. That is, since a second singulating apparatus 39 provides a second opportunity to separate any multi-feeds that may occur, the problems discussed above and associated with reducing the nip force in a single singulating apparatus structure are largely eliminated.

Figure 4:
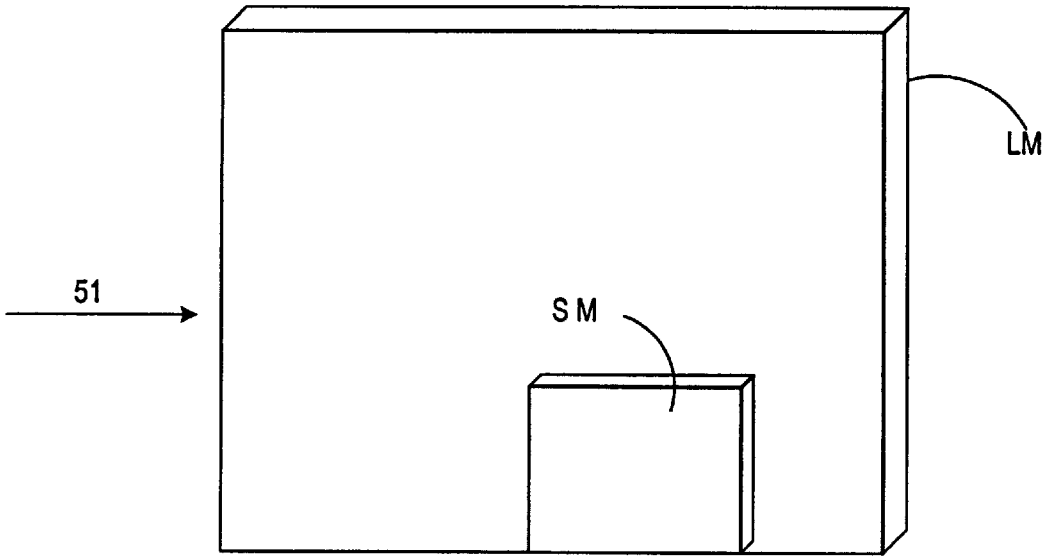
FIG. 4 shows a common multi-feed situation.
Figure 5:
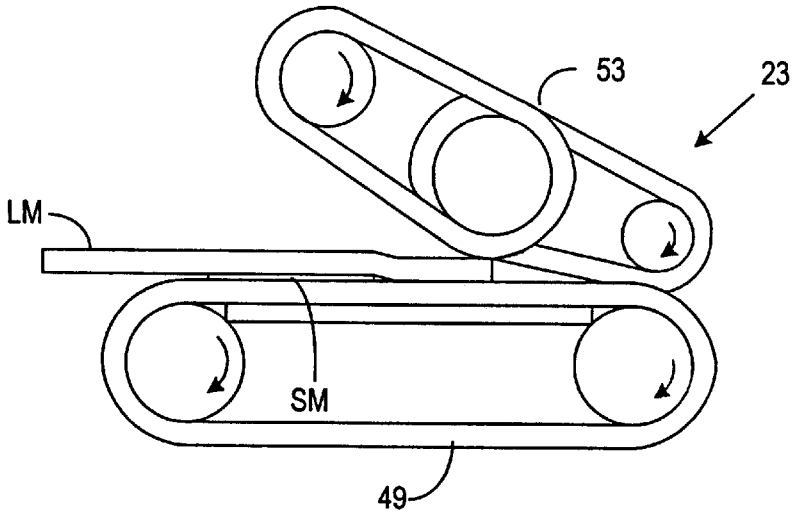
FIG. 5 shows the first singulator receiving mailpieces in an orientation that can lead to multi-feeds.
Figure 6:
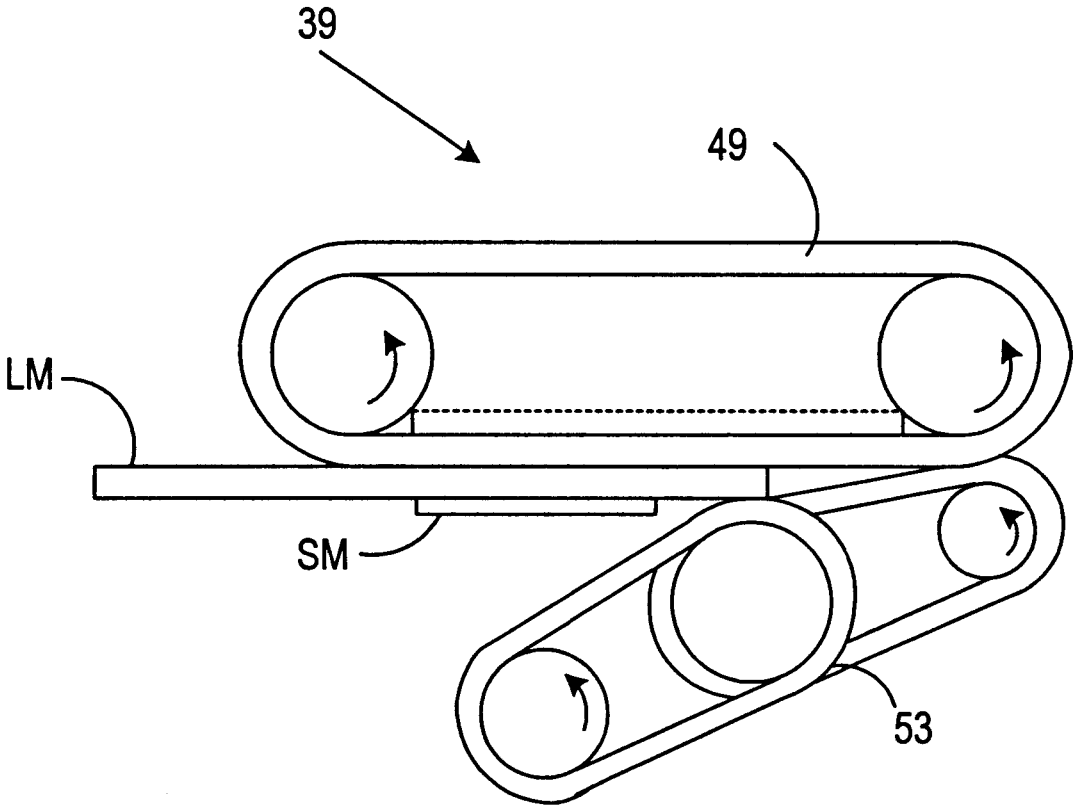
FIG. 6 shows the second singulator receiving the same mailpieces of FIG. 5.

It is also important to note that as shown in FIG. 1 not only are the singulating apparatus 23 and 39 aligned with each other along the mailpiece flow path 51, but the feed assembly 49 and the retard assembly 53 of the second singulating apparatus 39 are disposed in direct opposition to the corresponding feed assembly 49 and retard assembly 53 of singulating apparatus 23. The inventors have found that by changing the position of these components at the second singulating apparatus 39, as compared to the first singulating apparatus 23, helps to more effectively separate the documents of the multi-feed situation depicted in FIG. 4. That is, referring to FIGS. 5 and 6, the multi-feed situation of FIG. 4 is respectively shown at the first singulating apparatus 23 and the second singulating apparatus 39. FIG. 5 shows that as the large mailpiece LM enters the nip of singulating apparatus 23 it is fed downstream by feed assembly 49. However, once small mailpiece SM reaches the same nip it is not acted upon by the reverse assembly 53. Rather, the small mailpiece is also fed downstream by feed assembly 49 creating a multi-feed out of singulator 23. However, since the feed assembly 49 and reverse assembly 53 of singulating apparatus 39 are disposed in opposition to their corresponding structure in singulating apparatus 23, if the multi-feed that has passed through singulating apparatus 23 arrives at singulating apparatus 39 the large and small mailpieces LM and SM will be separated. That is, FIG. 6 show that when the multi-feed reaches singulating apparatus 39 the large mailpiece enters the nip and is fed downstream. However, when the small mailpiece SM enters the nip the reverse assembly 53 now acts on the small mailpiece SM effectively separating it from the large mailpiece LM. Finally, the buffer station 31 significantly improves the separation capability of the singulating apparatus 39 by reducing the inter-document forces between the large and small mailpieces LM and SM via its bottom edge transport and overall configuration such that separation is more easily achieved.

Additional advantages and modifications will readily occur to those skilled in the art. Therefore, the invention in its broader aspects is not limited to the specific details, and representative devices, shown and described herein. Accordingly, various modifications may be made without departing from the spirit or scope of the general inventive concept as defined by the appended claims. For example while the preferred embodiment is described in connection with a mail handling machine, any apparatus for handling mixed or same sizes/thicknesses of articles can utilize the principles of the invention. Additionally, while a singulator utilizing belts is described it is known to use rollers in lieu of the belts. Furthermore, in FIG. 1 the feed and retard assemblies of the first singulator 23 are shown as being disposed on an opposite side of the feed path 51 as compared to the corresponding structure in second singulator 39. However, the structure of both singulators 23 and 29 can be positioned along feed path 51 with the exact same orientation and the retard assembly of singulator 39 can also optionally be driven in two directions to effectively process shearable documents.

What is claimed is:

1. In a device for processing documents being transported therethrough along a document feed path, a singulating apparatus comprising:

a first singulator having a first retard assembly and a first feed assembly disposed opposite to each other along the document feed path, the first retard assembly and the first feed assembly cooperating together on a stack of documents subject to a stack advance mechanism force and being transported along the document feed path and passing between the first feed assembly and the first retard assembly to separate and transport downstream along the document feed path individual documents from the stack of documents; and a second singulator, positioned downstream along the document feed path from the first singulator, having a second retard assembly and a second feed assembly disposed opposite to each other along the document feed path, and wherein at times when a plurality of documents from the stack of documents that are in overlapping relationship with each other pass through the first singulator without being separated and without being subject to the stack advance mechanism force and are received by the second singulator the second retard assembly and the second feed assembly cooperate together on the plurality of documents to separate and transport individual ones of the plurality of documents downstream along the document feed path.

2. An apparatus as recited in claim 1, further comprising means for causing the first feed assembly to transport a lead document of the stack of documents downstream along the document feed path; and means for selectively operating the first retard assembly in either a first operating mode to prevent the documents of the stack of documents other than a lead document from being transported downstream in overlapped relationship to the lead document and a second operating mode whereby the first retard assembly cooperates with the first feed assembly to transport all of the documents of the stack of documents downstream along the feed path.

3. An apparatus as recited in claim 1 further comprising means, disposed between the first and second singulators, for reducing inter-document forces between the plurality of documents.

4. An apparatus as recited in claim 3, wherein the inter-document reducing means includes a first driven belt which contacts the bottom of the plurality of documents and transports the plurality of documents to the second singulator, and second and third driven belts disposed on opposite sides of the feed path and between which the plurality of documents are transported.

5. An apparatus as recited in claim 1, wherein the document feed path is defined by first and second opposing sides, the first retard assembly and the second feed assembly are positioned along the first side, and the first feed assembly and the second retard assembly are positioned along the second side.

6. An apparatus as recited in claim 5, wherein the first and second retard assemblies are reverse belt assemblies and the first and second feed assemblies are feed belt assemblies.

7. An apparatus as recited in claim 6, wherein the stack of documents includes documents of varying size.

8. An apparatus as recited in claim 7, wherein the stack of documents is a stack of mailpieces.

* * * * *